US005921890A

United States Patent [19]

Miley

[11] Patent Number: 5,921,890

[45] Date of Patent: Jul. 13, 1999

[54] PROGRAMMABLE AUDIBLE PACING DEVICE

[76] Inventor: Patrick Gerard Miley, 8 Irvine Way, Inverurie Aberdeen AB51 4ZR, United Kingdom

[21] Appl. No.: 08/952,334

[22] PCT Filed: May 16, 1996

[86] PCT No.: PCT/GB96/01174

§ 371 Date: Nov. 14, 1997

§ 102(e) Date: Nov. 14, 1997

[87] PCT Pub. No.: WO96/36404

PCT Pub. Date: Nov. 21, 1996

[30] Foreign Application Priority Data

May 16, 1995 [GB] United Kingdom ..... 9509849

[51] Int. Cl.[6] ..... G04B 47/00

[52] U.S. Cl. ..... 482/3; 434/254; 351/43; 2/426

[58] Field of Search ..... 482/1–9, 900–902; 351/43; 2/410, 425, 426; 434/247, 254

[56] References Cited

U.S. PATENT DOCUMENTS

| | | | |
|---|---|---|---|
| 3,492,582 | 1/1970 | Heywood . | |
| 3,789,402 | 1/1974 | Heywood et al. . | |
| 4,337,529 | 6/1982 | Morokawa . | |
| 4,566,461 | 1/1986 | Lubell et al. | 482/8 |
| 4,673,893 | 6/1987 | Shorkey . | |
| 4,776,045 | 10/1988 | Mysliwiec et al. | 2/426 |
| 4,796,987 | 1/1989 | Linden . | |
| 4,949,320 | 8/1990 | Karrenberg . | |
| 5,391,128 | 2/1995 | DeBear | 482/4 |
| 5,402,188 | 3/1995 | Wayne | 351/43 |

FOREIGN PATENT DOCUMENTS

| | | |
|---|---|---|
| 0 584 919 A2 | 3/1994 | European Pat. Off. . |
| 2 472 772 | 7/1981 | France . |
| 92 16 805 U | 4/1993 | Germany . |
| 2 025 093 | 1/1980 | United Kingdom . |
| 2 065 338 | 6/1981 | United Kingdom . |
| 2 099 192 | 12/1982 | United Kingdom . |
| 2 165 643 | 4/1986 | United Kingdom . |
| 2 175 508 | 12/1986 | United Kingdom . |
| WO 87/05229 | 9/1987 | WIPO . |
| WO 92/21106 | 11/1992 | WIPO . |

*Primary Examiner*—Glenn E. Richman

*Attorney, Agent, or Firm*—Matthew P. Vincent; Chinh H. Pham; Foley, Hoag & Eliot, LLP

[57] ABSTRACT

A programmable pacing device for helping a user to achieve a desired pace or tempo. The device is capable of emitting a plurality of different audible signals, each signal conveying selected pacing information to the user, and may be used by athletes to help in training or race pacing. The device may comprise a single unit or two separate units; an input unit and a signaling unit and as a single unit the device may form part of a pair of swimming goggles.

17 Claims, 4 Drawing Sheets

PROGRAMMABLE AUDIBLE PACING DEVICE

The present invention relates to a programmable pacing device which emits audible signals to a user at regular time intervals, the time intervals being pre-programmed by the user. The user may for example be a swimmer and the regular audible signals for pacing the swimmer's strokes, providing split times and informing the swimmer of his expected progress.

Proper pacing of athletes during training can permit accurate control of the energy being expended by the athletes and is an aid to improve performance. Top swimmers for example often use what are termed lactate training timetables. Lactate training timetables are tables that a swimmer uses as a guideline for predicting the amount of Lactic Acid produced during aerobic and anaerobic exercise. Entry points into the tables by individual swimmers are calculated from blood samples taken from swimmers after performing predetermined threshold swimming sets (i.e. sets designed to produce lactic acid production in the volume expected to be at the threshold of aerobic and anaerobic intensity for the individual swimmer). The Tables provide an accurate set of target times for particular swims with specified rest interval times, designed to control the intensity of training sets. Taking advantage of this facility enables swimmers and coaches to achieve more accurate physiological adaption throughout a training programme. By accurately pacing a swimmer it is easier to achieve the required lactate level as defined in the tables. Training regimes dictate when a particular lactate level is to be reached and the lactate training timetables tell a swimmer how far and at what pace they must swim in order to achieve the particular lactate level. At a lower level pacing may still lead to overall improvements in performance of the swimmer and can also simply be a fun and effective way in which to learn to swim.

A small ring lap counter and sports timer is available under the name SPORTCOUNT. The SPORTCOUNT (registered trademark) fits around an athlete's index finger and is secured thereto.

U.S. Pat. No. 4,796,987 describes swimming goggles which comprise a stopwatch mounted in a lens of the goggles. The swimmer can observe the elapsed time in a digital display, but is given little assistance in pacing strokes. Moreover, the swimmer may be distracted while looking at the display and/or by mentally calculating times, resulting in a loss of concentration.

EP584919 discloses swimming goggles which incorporate a visual signalling device. The visual signalling device is typically an LED (light emitting diode) which is set to flash a periodic signal in front of the swimmer's eyes. While the periodic signal can be set to help the swimmer achieve a desired pace, it still suffers from the disadvantage that it may be distracting to the swimmers vision and concentration.

WO 86/07644 describes a training device which can be set by a sportsman to emit signal so as to help the sportsman during training. The device is intended to be worn as a wristwatch, pocket watch or on a neck strap.

It is an object of the present invention to obviate and/or mitigate at least some of the above described disadvantages.

Generally speaking the present invention is concerned with an improved pacing device that may be programmed to emit audible signals to a user at time intervals which have been input and stored in the device by the user.

According to a first aspect of the present invention there is provided a portable electronic programmable pacing device for location on or adjacent a user's head, for assisting a user in maintaining a desired pace or tempo, the device comprising:

a clock for measuring elapsed time;

a user programmable memory capable of storing a plurality of pacing sets, each pacing set comprising at least two different time intervals, each time interval corresponding to selected pacing information;

input means for permitting a user to input said time intervals;

an audible signal device being capable of emitting series of different audible signals, each series corresponding to one of said pacing sets of time intervals; and switch means coupled to the clock for activating the audible signal output device at said time intervals.

The pacing device can be used for many sports and activities where pacing and/or timing are an important factor. For example, the pacing device may be used while swimming, cycling, running, rowing, during equestrian events such as dressage, and whilst in teaching aerobic or step-aerobic classes. The device may be used as a programmable metronome for musicians or conductors or teachers of music. The device may be used in the medical field for applications such as a walking pace device to assist in a proactive medical regime for example, as treatment for Parkinsons disease, or for other physiological therapy based activities. The device may assist the athlete and coach to train (or coach) more accurately by guiding the athlete to progress at a preset pace or tempo. If the device is to be used for a water sport or activity the device is of course waterproof.

The device may further comprise a digital or alphanumeric display, typically a liquid crystal display (LCD) or active matrix display unit. This allows the user to visualise and confirm data, for example, said time intervals, that have been input into the device. Moreover, elapsed time as measured by the clock generally a quartz-crystal clock, may also be visualised as a digital read-out on the LCD. Preferably, the clock is accurate to fractions of a second, typically, tenths or hundredths of a second. There can be a mathematical adaption in the software made to input and indicate stroke rate or rate as strokes/paces/steps per minute.

The user programmable memory may store a plurality of sets of time intervals. The memory may retain the stored time intervals when the device is switched off, in which case the stored time intervals must be actively erased if a new set or sets of time intervals are to be programmed into the memory. Alternatively, the memory may be erased when the device is switched off.

Various time intervals may be stored by the memory, depending on the user's needs. The time intervals may for example dictate the user's pace and a time in which a course or a section of a course should be completed (a so called "split time"). Thus, for example, in the case of a swimmer, a pace time interval will correspond to stroke rate indicated by time per stroke and a course time interval may correspond to time taken to swim a length of a pool. Additional data not in the form of time interval data may also be programmed and stored by the memory. Such data may include the course length. In the case of swimming, this may for example correspond to a 25 metre (short course) pool or a 50 metre (long course) pool or 33.3 metre pools or yardage pools if applicable. This may for example allow a swimmer to be aware of the number of strokes he is carrying out per length. A processor within the device permits the device to calculate and accommodate multiple time intervals and to equate this with any additional data entered into the device.

The input means for inputting said time intervals and any other data may be keys or buttons provided on the device. Pressing of the keys or buttons in a defined manner allows the device to be programmed. Alternatively data may be fed using a bar code. Thus, the device would further comprise a bar code reader for use with a set of bar codes corresponding to particular pacing data. The device may be scanned across the relevant bar codes, in order to feed a particular time interval or data value into the device.

The switch means may be a comparator which receives at a first input a clock signal derived from said clock mechanism and at a second input one of said time intervals. The output of the comparator is switched when the clock signal exceeds said time interval causing an audible signal to be generated. Switching of the comparator also causes said clock signal to be reset to a zero or initialised state.

The audible signal device emits an audible signal or sound. The audible signal may be in the form of a "bleep" or tone. Different pitches or frequencies, lengths or arrangements of bleeps or tones convey different pacing information to the user. For example on starting the device a five bleep low pitch countdown may be emitted by the device with a longer bleep to indicate the start time of a set programme, this is in turn followed by a higher pitch pacing bleep. A longer bleep may then indicate a split. The user can easily assimilate this information and through the use of bleeps or tones of varying frequency or length, the user can easily interpret the information being conveyed and may act accordingly, that is, speed up or slow down, or maintain current pace.

Alternatively, music having a rhythm or beat set to the corresponding programmed time interval may be emitted by the device. Furthermore, the audible signal may be a synthesised voice or the like designed to emit a spoken words to the user. The synthesised voice may express terms such as "stroke" and "split"so as to indicate the timing of strokes and when the swimmer is expected to reach a particular split interval. The voice synthesis may be reprogrammed or programmed in by the user. Possibly in the form of the users own voice or own choice of sounds.

The device may comprise a single unit or a two-piece unit. The single unit is small enough to be worn comfortably by the user. Preferably the unit is worn in close proximity to an ear. The single piece unit may be shaped to fit round the outside of the ear or alternatively comprise an ear piece which fits inside the ear. The device may alternatively be held close to the ear by fitting the device under a hat or swimming cap, indeed the device for swimming can be located anywhere on the head as the attenuation of sound through the skull in water is very effective. Optionally, the device may further comprise a securing means to enable the device to be secured in close proximity to the ear. The device may be designed to be secured to the strap of swimming goggles or to the leg portion of spectacles or eye-protectors. The securing means may be arranged as a hinged flap which opens to receive a strap or leg and which is then closed to secure the device thereto. Alternatively the securing means may hook over the strap or leg and secure the device thereto. In a preferred embodiment the device forms an integral component of a pair of swimming goggles.

In an alternative two-piece construction, the device may comprise a separable input unit and a signalling unit. The signalling unit is carried by the user and comprises the audible signal device for emitting said audible signals to the user. A signalling unit can be held or secured close to the user's ear in a similar manner to that described above. The input unit allows the user to input the relevant data such as the time intervals and this information is then stored by a memory in the input unit. The information is relayed or downloaded to the signalling unit at an appropriate time. The signalling unit may be coupled or connected to the input unit and the information relayed by way of electrodes associated with the input and signalling units.

Alternatively, the information may be relayed to the signalling unit by way of infra-red transmission or radio transmission. This allows remote programming, that is, a coach may input the relevant time interval information into the input unit and remotely relay this information to the signalling unit. A swimmer for example carrying a signalling unit and following a pacing information previously input, may have his pacing information changed by his coach on the side of the pool and need not leave the water or remove his signalling unit. It is also possible to program many signalling units using a single input unit. Thus, a swimming coach may have one input unit and a plurality of signalling units, each of which can be programmed with time information specific to a particular swimmer.

According to a second aspect the present invention provides swimming goggles including an electronic programmable audible pacing device for aiding a user to achieve a regular stroke rate by emitting an audible signal to the user at time intervals input into the device.

Figure 1:
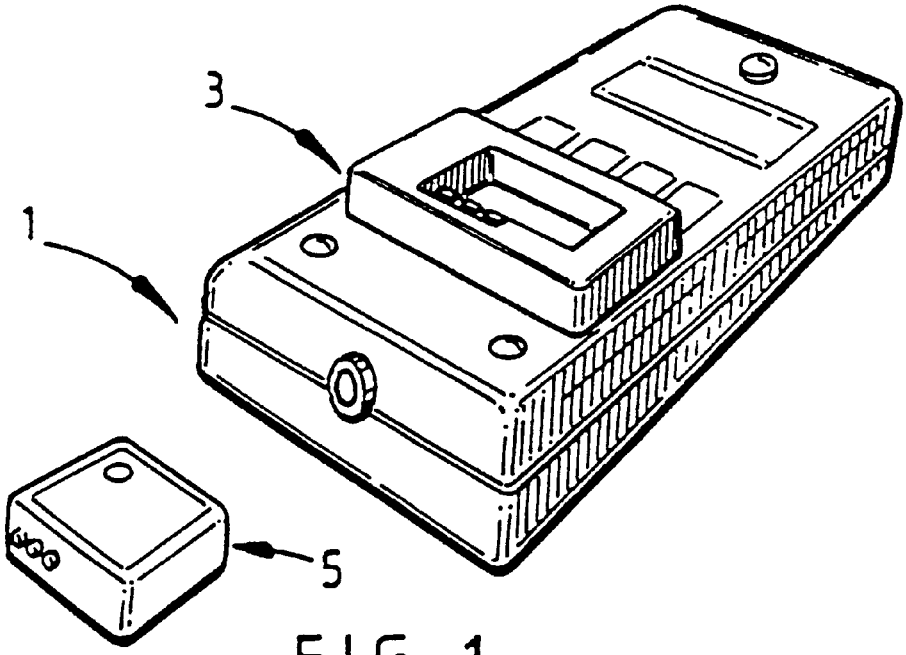
FIG. 1 is a perspective view of a two-piece pacing device comprising an input unit and a signalling unit according to an embodiment of the present invention.

FIG. 1 of the drawings shows an embodiment of a programmable pacing device 1 according to the present invention, comprising an input unit 3 and a signalling unit 5. Data such as relevant pacing time intervals is entered into the input unit 3 and this information is downloaded to the signalling unit 5 for use by the athlete or swimmer.

Figure 2:
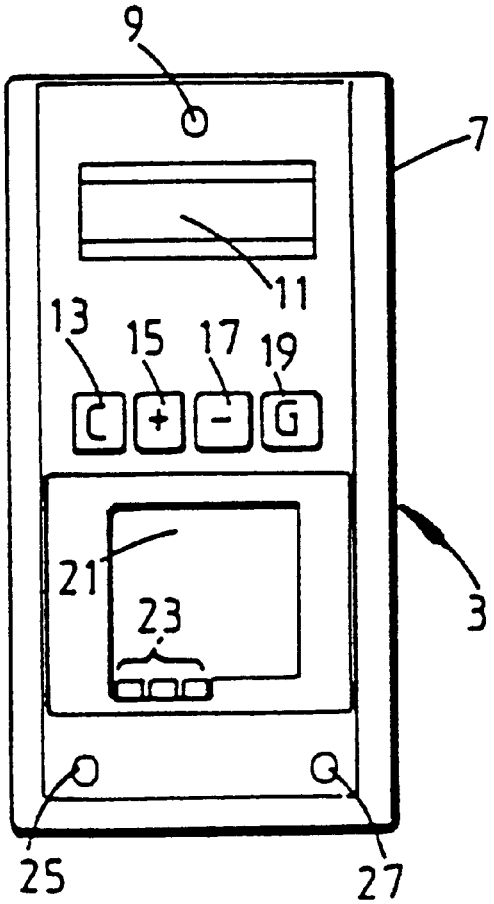
FIG. 2 is a front view of the input unit of FIG. 1.

The input unit 3 as is also illustrated in FIG. 2, comprises a housing 7 which contains all the necessary electrical circuitry including a microprocessor and a rechargeable battery unit. The front face of the housing 7 features an on/off button 9, which activates an LCD display 11. The LCD display 11 allows a user to visualise data being input into the device so that the user can confirm that the data has been input correctly. The data is entered into the input unit by way of input buttons 13, 15, 17 and 19. The data which can be input into the device includes stroke or pace time intervals in seconds per pace/stroke, pace and split time intervals. The split time represents a time in which a particular course, for example, a length of a pool, should be completed. Multiple sets up to a maximum of 60 sets of pace times and split times may be entered in the input unit 3. Programming of the input unit 3 will be described in detail later.

The input unit 3 further comprises a recess 21 into which the signalling unit 5 is received. Electrodes 23 in the recess 21 make contact with corresponding electrodes of the signalling unit 5. Data from the input unit 3 is downloaded from the input unit 3 to the signalling unit 5 by way of the electrodes 23, power to recharge the signalling unit 5 is also transferred via the electrodes 23.

A light emitting diode (LED) 25 illuminates when the input unit 3 is being recharged and a further LED 27 illuminates when the signalling unit is connected to the input unit and is also being recharged. An external charge source AC or DC 18 volts regulated or 12 volts unregulated may be connected to the input unit via socket 29 (as shown in FIG. 1) to allow the input unit and signalling unit to be recharged.

Figure 3:
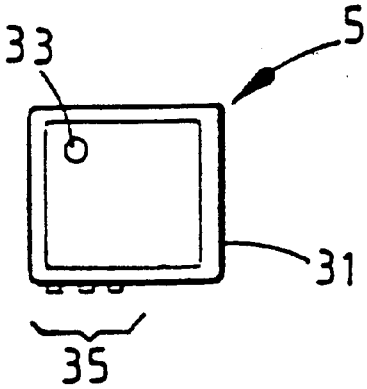
FIG. 3 is a front view of the signalling unit of FIG. 1.

FIG. 3 shows the signalling unit 5. The signalling unit 5 comprises a housing 31 which contains the necessary electrical circuitry including a microprocessor, a sounder and a rechargeable battery unit. The signalling unit 5 further comprises a start/go button 33 and electrodes 35 for electrically coupling to electrodes 23 of the input unit 3, as shown in FIG. 2.

Figure 4:
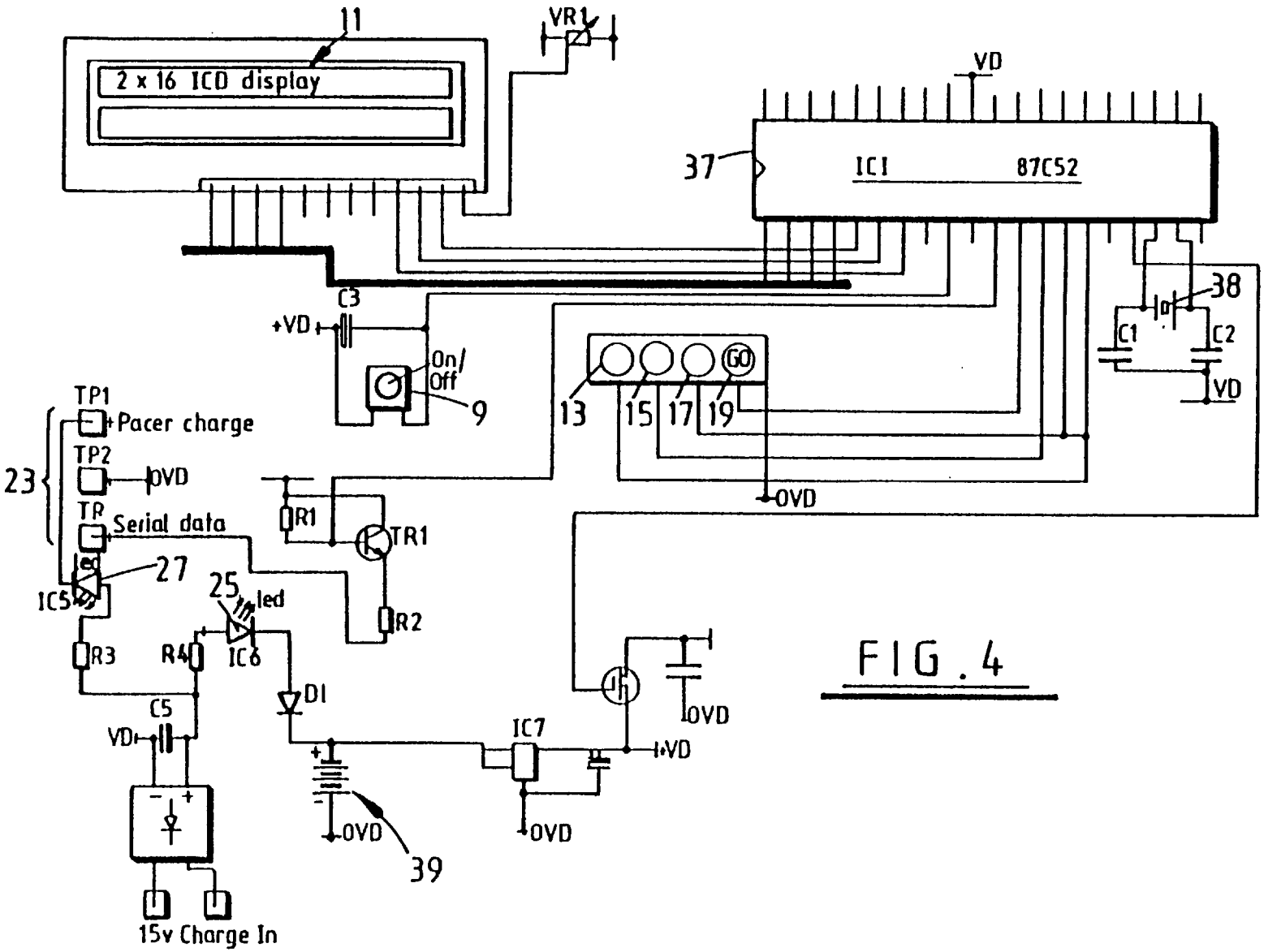
FIG. 4 is a diagram of the electrical circuitry of the input unit of FIG. 1.

FIG. 4 shows a circuit diagram of the input unit 3. There is shown the on/off button 9, LCD display 11, input buttons 13, 15, 17 and 19, electrodes 23 and recharge lights 25, 27. Additionally, there is shown a microprocessor 37 from the 80C51 family (87C52), quartz crystal 38 for use in accurately controlling the timing of the device and a battery 39 for providing power to the input unit 3.

Figure 5:
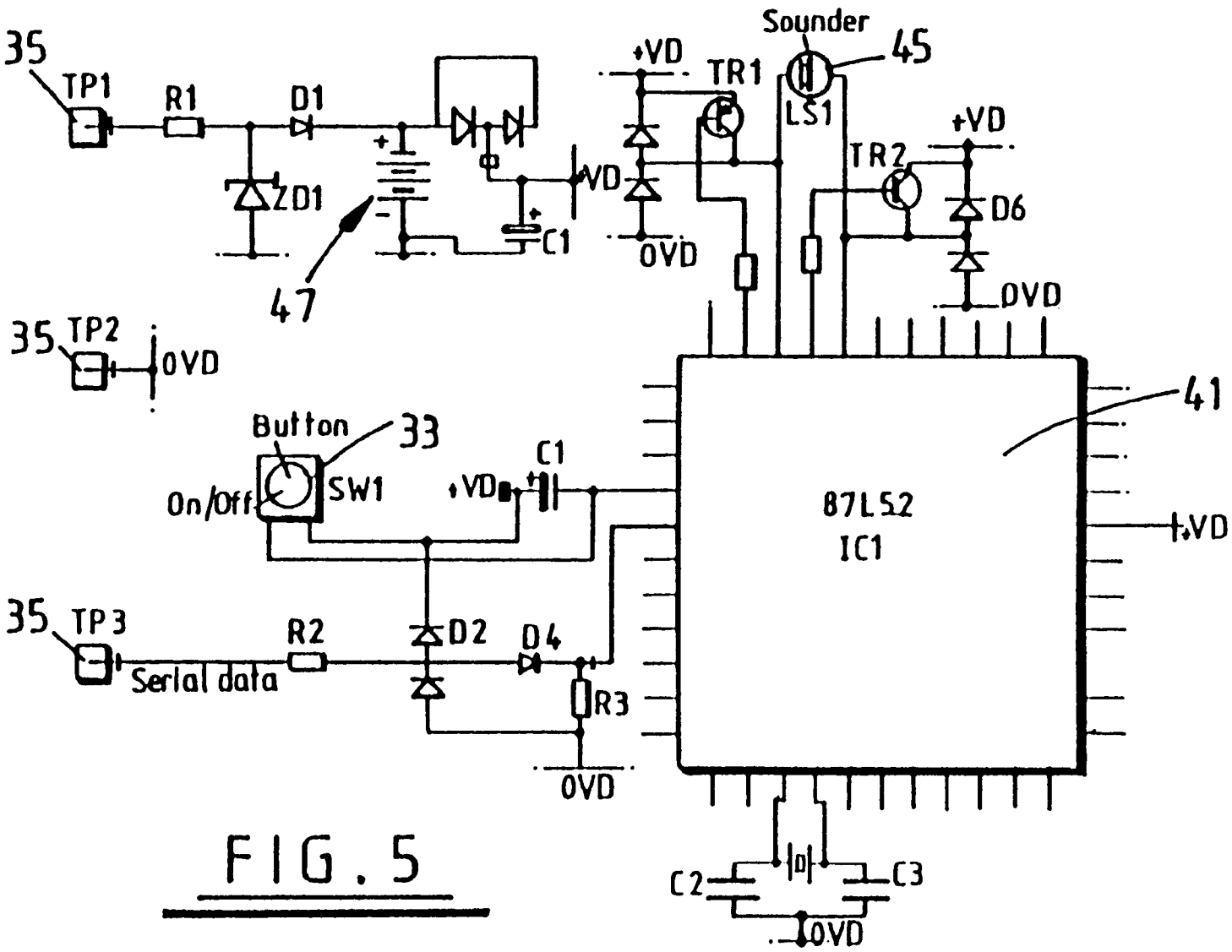
FIG. 5 is a diagram of the electrical circuitry of the signalling unit of FIG. 1.

FIG. 5 shows the electrical circuitry found in the signalling unit 5 and includes the stop/go button 33 and electrodes 35. In addition, there is also shown a microprocessor 41 from the 80C52 family (87L52), with an associated quartz crystal 43 and a sounder 45 which emits an audible signal to the user. Furthermore, there is shown a battery 47 which provides power to the signalling unit 5.

An example of how the input device is programmed will now be given, with particular reference to FIG. 2 of the drawings. It will be appreciated that the programming regime which is to be described is determined by software stored by the microprocessor. The following is merely one example of how the device may be programmed. The input unit 3 is first switched on using the on/off button 9 which in turn activates the LCD display 11. The LCD displays information input into the unit 3 allowing a user to visualise the input information. The unit 3 stores the information programmed from the previous input when the unit 3 is switched off. If a user wishes to erase the stored information from the input unit, the user depresses button 13 while switching the device on using button 9, this then clears the previously stored information.

The LCD display 11 displays two lines of information. The first line displays a leg number and the second line displays time interval information. To program a first leg, button 19 is depressed, this moves the cursor down to the second line. The first time interval information to be input relates to the split time, that is, the time the swimmer is to complete a given course length. Depressing button 15 once, brings up ten seconds on the display and each additional depression of button 15 increases the time interval by one second intervals over that. Thus, a split time of fifteen seconds would mean depressing button 15 six times. Pressing the minus button, 17, can subtract the figures from 10 seconds down to 0 seconds or as required. Once the split time has been entered correctly, button 19 is depressed and the display moves onto the pace or stroke rate time interval. Button 15 is depressed to increase the stroke rate by 0.1 second (intervals may be as accurate as 0.01 second by adjusting the software) until the desired time is shown in the LCD display 11.

If a mistake is made at any time it is possible to reduce the figure by depressing button 17 which acts in reverse to button 15 and thus subtracts from the input time interval or goes back through the program sequence in reverse. Once the user is satisfied with the pace time, button 19 is depressed and the first leg is thus stored by the unit 3. The user can then go on to program additional legs in the manner described above in order to program a set of legs.

If however, the user wishes to repeat any of the legs, he simply goes back to the start of the previous leg and depresses button 13. This in turn copies the previous leg information onto the subsequent leg. For example if a swimmer was wishing to carry out a hundred metre swim using a twenty-five metre pool they would wish to enter information for four separate legs to complete a set. They can enter a time that they wish to complete each of the legs in and the stroke rate to be achieved for each leg.

It is also possible to repeat a set and in order to do this the user depresses button 17 to go backwards through a programmed set until the first leg of that set is reached. The user then depresses button 19 which indicates to the input unit that a program is to be repeated and the user then depresses button 15 until the leg number after which the program is to be repeated is shown in the display. Thus, if an initial program had four legs and the user wanted to repeat those four legs after the final fourth leg he would go back through the program depressing the button 17 until the leg 1 information was shown, then depresses button 19 followed by button 15 to go back through the leg numbers until the fourth leg is shown in the LCD display and then button 19 is depressed once more.

The user is then invited to enter a delay or rest interval between the sets. The user simply depresses button 15 to move upwards through the numbers until his desired rest interval is displayed in the LCD display 11.

Once a program is complete buttons 15 and 17 are depressed together and the user is then instructed to insert the signalling unit into the recess 21 of the input unit, press the "on" button (FIG. 3 No. 33) on the signalling unit and then instructed to press button 19. This immediately downloads the information input into the input unit 3 into the signalling units. If correctly done, the signalling unit bleeps, indicating that the signalling units has now been programmed.

The swimmer may now remove the signalling unit 5 from the input unit 3 for his programmed swimming set. The swimmer secures the signalling unit 5 in close proximity to the swimmer's skull. For example the signalling unit may be placed inside the swimmer's cap. When the swimmer is ready to start a set he simply presses button 33 of the signalling unit 5 whereupon he is given a five second countdown in the form of audible bleeps, if requested as part of the program. Once the five second countdown has been completed and the swimmer has dived into the pool and audible pacing bleep of a different frequency to that of the five second countdown is emitted so as to convey to the swimmer his desired stroke rate. A different frequency longer bleep is emitted when the first split time is reached. The swimmer would then proceed onto the second leg and the signalling unit would sound out a pacing bleep corresponding to a pacing time interval input for that particular leg, until the second split time bleep is emitted. This proceeds until the pre-programmed set has been completed.

The swimmer accurately maintains a stroke rate corresponding with the bleeps emitted by the signalling unit 5 and is additionally instructed when they should be completing the course by a separate split time bleep.

Figure 6:
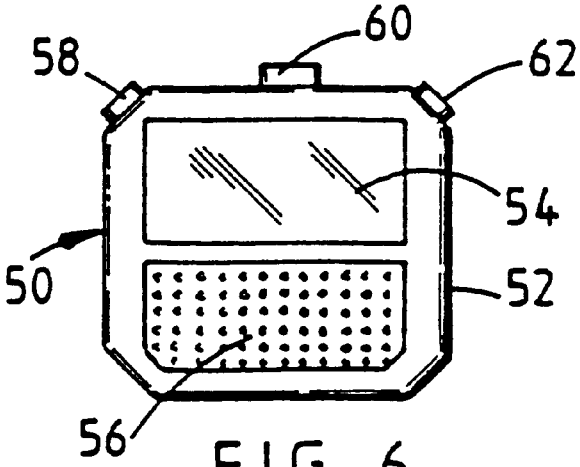
FIG. 6 is a front view of a one-piece pacing device according to a further embodiment of the present invention.

FIG. 6 shows a one piece programmable pacing device 50 in accordance with a further embodiment of the present invention, which is designed to be worn on the strap of a pair of swimming goggles. The device 50 comprises a waterproof housing 52 in which there is contained the necessary programmable processor and battery unit. The device can also optionally be used as a stopwatch.

The device comprises an LCD display 54, a large start/stop button 56 and three control buttons 58, 60 and 62. The control buttons 58, 60 and 62 control the stopwatch, mode selection and allow programming of the pacing facility. The device may be programmed in a manner similar to the two-piece programmable pacing device described above, but without the need to download information from an input unit to a signalling unit.

Figure 7:
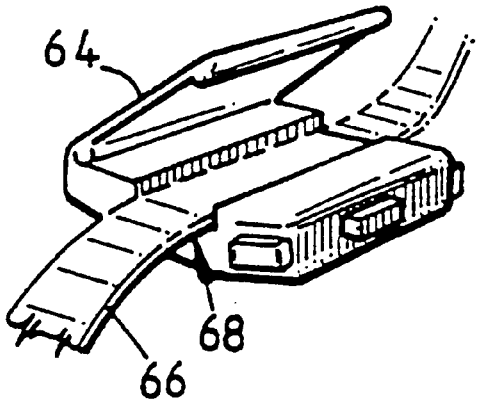
FIG. 7 shows, in perspective, the pacing device of FIG. 6 secured to a strap of a pair of swimming goggles.
Figure 8:
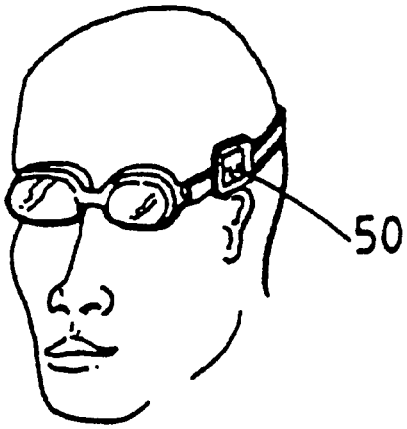
FIG. 8 shows the pacing device of FIG. 6 when worn by a swimmer.

FIG. 7 shows how the programmable pacing device of FIG. 6 is secured to a swimmer's goggle strap. The device 50 comprises a hinged portion 64 which opens to allow the goggle strap 66 to be placed within a small recess 68 formed in the back of the device 50. The hinged portion 64 is then closed to retain the device on the goggle strap 66. FIG. 8 shows how the device may look when secured to a swimmer's goggle strap, when worn by a swimmer.

Figure 9:
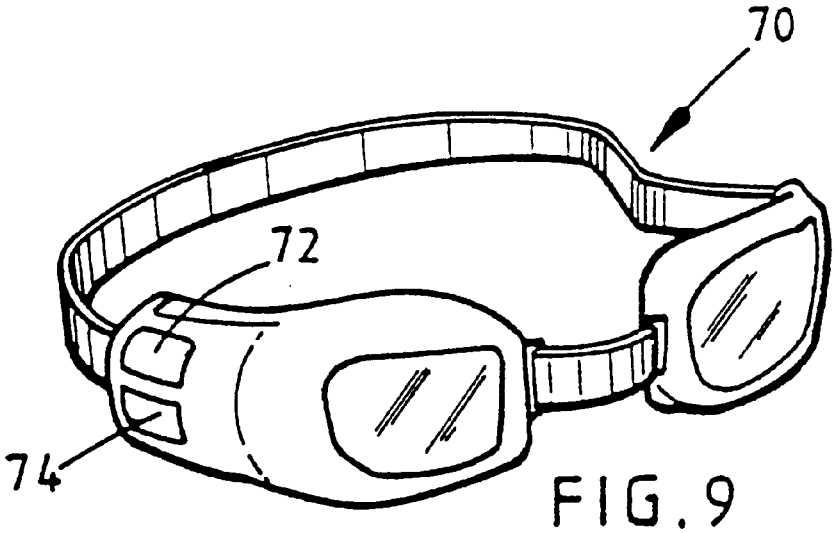
FIG. 9 is a perspective view of a pair of pacing swimming goggles according to a further embodiment of the present invention.

FIG. 9 shows a pair of pacing/swimming goggles 70 in accordance with a further embodiment of the present invention wherein a pacing device is formed as an integral component of a pair of swimming goggles. The pacing device is controlled/programmed by way of two buttons 72, 74. An example of programming the device is as follows: button 72 is depressed once followed by a pause of two seconds and then pressed again four times to designate a stroke rate of 1.4 seconds per stroke. After a further pause of two to three seconds button 72 is depressed once again to input the time interval. Two presses followed by a pause and seven presses will enter a split time of 27 seconds. Depressing of button 74 indicates that the programming is complete after which a series of bleeps mimicking the input occurs to allow the user to confirm that the input data is correct. Depressing button 74 once more would start the pacing device.

The portable electronic pacing device of the present invention provides a number of advantages over previously known device. In particular, the audible signal for instructing the user is not distracting in any way, unlike the visual pacing devices previously known.

The device allows complete control for the athlete when planning the pacing of a training program due to the programmable nature of the device and this may lead to increased efficiency of training regimes. The device may be used across all levels of expertise from beginners through to world class athletes, as the device can be individually programmed to a user's particular needs.

The device is easily used in conjunction with other training aids such as lactate training timetables used by swimmers and could additionally be combined with a heart rate monitor to give an even more controlled training program.

The signalling unit may receive data from a personal computer, portable laptop computer or even a palmtop computer through a serial link or the like. Furthermore data from the device can be downloaded into a computer. The data can then be used for storage, records or further analysis.

In addition to finding particular application with regard to swimmers, other athletes such as tri-athletes may find use for the device. A tri-athlete could use a headband to which the pacer is attached and input pace rate for each of the three events (swimming/cycling/running) that the tri-athlete must complete. Equally a tri-athlete may remove the head located signalling unit and fix it to a bike for the cycle leg and then to a wrist strap housing for the run section.

It will be immediately evident to one skilled in the art that various modifications can be carried out to the device described above without departing from the scope of the present invention.

I claim:

1. A portable electronic programmable pacing device (1,50) for location on or adjacent a user's head, for assisting a user in maintaining a desired pace or tempo, the device comprising:

a clock for measuring elapsed time;

a user programmable memory (4) capable of storing a plurality of pacing sets, each pacing set comprising at least two different time intervals, each time interval corresponding to selected pacing information;

input means (13,15,17,19) for permitting a user to input said time intervals;

an audible signal output device (45) capable of emitting series of different audible signals, each series corresponding to one of said pacing sets of time intervals; and switch means coupled to the clock for activating the audible signal output device at said time intervals.

2. A portable electronic programmable pacing device according to claim 1 further comprising a display (11) for displaying time interval information.

3. A portable electronic programmable pacing device according to claim 2 further comprising a stopwatch feature wherein stopwatch information is visualised on the display.

4. A portable electronic programmable pacing device according to claim 1, wherein the clock measures in increments of tenths of a second.

5. A portable electronic programmable pacing device according to claim 1, wherein the clock measures in increments of hundredths of a second.

6. A portable electronic programmable pacing device according to claim 1, wherein each pacing set comprises pacing information corresponding to a pace time interval and pacing information corresponding to a course time interval.

7. A portable electronic programmable pacing device according to claim 1, wherein the input means is keys provided on the device.

8. A portable electronic programmable pacing device according to claim 1, wherein the input means is a bar code reader, the bar code reader being used in combination with a set of bar codes corresponding to particular time interval data.

9. A portable electronic programmable pacing device according to claim 1, wherein the audible signal device emits different frequencies, lengths and/or arrangement of sounds for conveying the pacing information to the user.

10. A portable electronic programmable pacing device according to claim 1, where the device further comprises securing means for securing the device on or adjacent the user's head.

11. A portable electronic programmable pacing device according to claim 1 wherein the device further comprises securing means for enabling the device to be secured in close proximity to an ear of a user.

12. A portable electronic programmable pacing device according to claim 11 wherein the securing means is a hinged flap (64) openable to receive a strap or leg and closeable to secure the device thereto.

13. A portable electronic programmable pacing device according to claim 1, wherein the device comprises a separate input unit (3) and a signaling unit (5), including memory, whereby the input unit allows the user to input the relevant time interval information and this information is down loaded to and stored by the signaling unit, for emitting said audible signals, conveying said time interval information to the user.

14. A portable electronic programmable pacing device according to claim 1 wherein the device further comprises securing means for enabling the device to be secured to a bicycle for use by a cyclist.

15. A portable electronic programmable pacing device according to claim 1, further including a heart rate monitor.

16. A portable electronic programmable pacing device according to claim 1 wherein the device comprises a separable input unit and a signaling unit, whereby the input unit allows the user to input the relevant time interval information and this information is down loaded to the signaling unit for emitting said audible signals to the user.

17. Swimming goggles (70) including an electronic programmable audible pacing device for helping a user to achieve a regular stroke rate by emitting series of audible signals to the user at time intervals input into the device, the device comprising:

a clock for measuring elapsed time;

a user programmable memory capable of storing a plurality of pacing sets, each pacing set comprising one or more different time intervals, each time interval corresponding to selected pacing information;

input means (72,74) for permitting a user to input said time intervals;

an audible signal output device capable of emitting series of different audible signals, each series corresponding to one of said pacing sets of time intervals; and switch means coupled to the clock for activating the audible signal device at said time intervals.

* * * * *